US007784249B2

(12) United States Patent
Lindblad et al.

(10) Patent No.: US 7,784,249 B2
(45) Date of Patent: Aug. 31, 2010

(54) METHOD AND AN APPARATUS FOR STERILISING PACKAGES

(75) Inventors: Ulf Lindblad, Lund (SE); Jenny Karolina Olsson, Bjärred (SE); Anders Sundberg, Södra Sandby (SE)

(73) Assignee: Tetra Laval Holdings & Finance S.A., Pully (CH)

( * ) Notice: Subject to any disclaimer, the term of this patent is extended or adjusted under 35 U.S.C. 154(b) by 32 days.

(21) Appl. No.: 12/063,219

(22) PCT Filed: Jul. 13, 2006

(86) PCT No.: PCT/SE2006/000874

§ 371 (c)(1),
(2), (4) Date: Feb. 7, 2008

(87) PCT Pub. No.: WO2007/024172

PCT Pub. Date: Mar. 1, 2007

(65) Prior Publication Data

US 2008/0190072 A1 Aug. 14, 2008

(30) Foreign Application Priority Data

Aug. 23, 2005 (SE) ..... 0501872

(51) Int. Cl.
*B65B 55/04* (2006.01)

(52) U.S. Cl. ..... 53/426; 53/79; 53/403

(58) Field of Classification Search ..... 53/85, 53/86, 425, 426, 403, 79; 422/302, 303
See application file for complete search history.

(56) References Cited

U.S. PATENT DOCUMENTS 2,492,873 A 12/1949 Lamb
2,771,645 A 11/1956 Martin
3,531,908 A * 10/1970 Tuma et al. ..... 53/426
3,640,072 A * 2/1972 Kayser ..... 60/258
4,140,159 A * 2/1979 Domke ..... 141/129

(Continued)

FOREIGN PATENT DOCUMENTS

EP 0755686 A2 1/1997

(Continued)

OTHER PUBLICATIONS

Form PCT/ISA/210 (International Search Report) datedOct. 26, 2006 and Feb. 1, 2006.

(Continued)

*Primary Examiner*—Thanh K Truong
(74) *Attorney, Agent, or Firm*—Buchanan Ingersoll & Rooney PC

(57) ABSTRACT

A method and apparatus for supplying a gas or gas mixture to the inside of partly formed packages which are ready-to-fill, before a subsequent filling and sealing of the packages in a filling machine. The method involves supplying the gas or gas mixture at any given moment as a flow which is radially outwardly and inwardly defined in relation to the inner wall of the package, with the flow being angled with respect to the geometric major longitudinal axis of the package which intersects its opening so that the flow, since it is defined by the inner wall of the package, is positively controlled for the formation of a helical flow vortex.

20 Claims, 3 Drawing Sheets

U.S. PATENT DOCUMENTS

| | | | | |
|---|---|---|---|---|
| 4,560,567 | A * | 12/1985 | Rausing | 426/399 |
| 5,141,035 | A * | 8/1992 | Nish et al. | 141/1 |
| 5,178,841 | A * | 1/1993 | Vokins et al. | 422/298 |
| 6,457,299 | B1 * | 10/2002 | Schwenke et al. | 53/510 |
| 6,692,684 | B1 * | 2/2004 | Nantin et al. | 264/521 |
| 6,984,360 | B1 * | 1/2006 | Feuilloley et al. | 422/28 |
| 2002/0069636 | A1 * | 6/2002 | Knuth et al. | 60/205 |
| 2005/0198923 | A1 | 9/2005 | Wolters et al. | |
| 2006/0067856 | A1 * | 3/2006 | Martensson et al. | 422/33 |

FOREIGN PATENT DOCUMENTS

| | | | |
|---|---|---|---|
| JP | 2000-202388 | A | 7/2000 |
| JP | 2002-102813 | A | 4/2002 |
| TW | 181929 | | 4/1992 |
| TW | 384270 | | 3/2000 |
| TW | 593069 | | 6/2004 |
| WO | WO 2004/054883 | A1 | 7/2004 |

OTHER PUBLICATIONS

Form PCT/ISA/237 (Written Opinion of the International Searching Authority) dated Oct. 26, 2006.

Search Report for Taiwan Patent Application No. 095127209 dated Oct. 25, 2007 and English Translation.

* cited by examiner

METHOD AND AN APPARATUS FOR STERILISING PACKAGES

TECHNICAL FIELD

The present invention relates to a method and an apparatus for sterilising at least partly formed packages which are ready-to-fill packages, in a filling machine. The term sterile is taken to signify in the following disclosure that the package, after sterilisation, attains a level of sterilisation which is designated commercially sterile.

More precisely, the present invention relates to a method, prior to filling of such packages, of treating and sterilising them in a filling machine before a subsequent aseptic filling. The packages have an open and a closed end. A first context in which the method according to the present invention may be implemented is in connection with the introductory supply, before filling of such packages, of hot air from the open end of the packages in order to heat them up with a view, in a later sterilisation stage, to preventing sterilisation gas from condensing on the walls of the packages. Another manner of implementing the method is to supply sterile tempered air once the package has been gassed with sterilisation gas. The purpose here is to ventilate off the sterilisation gas. More specifically, the present invention relates to a method of supplying and removing an optional gas, hence also sterilisation gas to and from the open end of the package.

The present invention further relates to an apparatus which is included in a larger context for realising a gas sterilisation of packages in said filling machine where the larger context includes, on the one hand, a heating zone, and on the other hand a sterilisation zone or a combination thereof and further a ventilation zone. The sterilisation agent is intended to remain in gas form throughout the entire sterilisation stage and is intended to the greatest possible degree to be reused. For a more detailed description of one type of an apparatus and a method for producing and sterilising a package which is referable to this group, reference is made to published international application WO2004/054883.

BACKGROUND ART

In filling machines of said type, use has previously been made of a method of approach which entails that, during the gas sterilisation stage, a sterilisation gas is supplied centrally in conjunction with the open end of each package. For reasons of process engineering, the sterilisation gas flow has been allowed to remain constant, regardless of the necessary movements in the filling machine. This is linked to the situation that the relevant technology is applicable in connection with filling machines of different types, such as also those of the tube filling- or carousel filling type. It has proved that, in certain cases, there may be a minor risk that the sterilisation gas which, in a previously known manner, is supplied to packages of this type in some cases does not reach the small areas and pockets of the package which are located least readily accessible in relation to the sterilisation agent supplying device. This applies particularly to such packages which display a relatively large ratio between their length and their main axis cross section. It has long been assumed that it is possible to reach these small areas and pockets of the packages located least readily accessible by maintaining a high constant gas mass flow in the supplied sterilisation gas. However, it has now been established that, above all in certain cases, there is a risk that the preselected level of sterilisation will not be achieved simply by this measure.

BRIEF SUMMARY OF THE INVENTION

One object of the present invention is to disclose a method, with the best conceivable overriding control prior to filling of a ready-to-fill package under aseptic conditions, to carry out a gas sterilisation process of the inside of said package to the preselected level of sterilisation, with a considerably lower gas mass flow of the supplied gases or gas mixtures as compared with the prior art.

More specifically, one object of the present invention is to disclose a method which, in particular in the specifically disclosed case, obviates the risk that the sterilisation will be incomplete, at the same time as the mass flow of the supplied gases is greatly reduced compared with the prior art.

Yet a further object of the present invention is to realise a method which makes for a considerably higher level of reusing of the supplied sterilisation gas.

Yet a further object of the present invention is to disclose an apparatus for, on the one hand, realising a reduction of the risk of re-infection or contamination with a view to better being able to guarantee the shelf-life of the product which is subsequently filled into the package, and, on the other hand, for realising a reduction of the gas mass flow in connection with the sterilisation and thereby improve the economy of the process, whereby considerably improved possibilities will occur for reusing, in particular concerning the supplied sterilisation gas. As a result, the unintentional spreading of the sterilisation gas in the aseptic chamber can be restricted to an even higher degree than before. Said chamber consists, on the one hand, of a unit for the supply of hot air, and, on the other hand, of a unit for the supply and removal of sterilisation agent, and also a unit for ventilation of packages of sterilisation gas before they are filled.

According to the present invention, there is provided a method of the type disclosed by way of introduction of this specification by means of which the above-described purposes are attained in that each respective supplied gas flow, in particular the gaseous sterilisation agent, is supplied as a flow which is radially both outwardly and inwardly defined in relation to the package. The flow is angled with respect to the geometric major axis of the package which intersects its opening at a right angle that, since it is defined by the inner wall of the package, it forms a positive helical flow vortex. The vortex which is formed has a very good capability of reaching all pockets and nooks in the package. The thus created flow vortex forms, as a consequence that it must, by some means, find a way out again, a central return flow thanks to a lower gas pressure in this central region. Hereby, the gas velocity may, regardless of the gas type which is employed, be reduced. One advantage inherent herein is that it is thereby possible to eliminate positive flow vortices in the treatment chamber. Furthermore, there will be provided according to the invention an apparatus for reducing the method into effect which comprises a nozzle for each respective gas flow, which includes at least one gas supply means which is directed/angled in relation to a plane including that one of the geometric major axes of the package which intersects its opening so that the flow therefrom, when it impinges on the inner wall of the package, develops and maintains a radial both inwardly and outwardly defined, as good as helical flow. In order to attain the best possible flow distribution when gas is supplied, it has proved in trials hitherto that the supply means should encompass some ten-odd apertures, where each one of them moreover advantageously should be angled in such a manner that it makes an angle of less than 8° to each one of the two planes of symmetry to the package which have the axis of symmetry intersecting the opening under a right angle as a common line. This implies more precisely that each aperture is directed in a first direction slightly peripherally and in a second direction slightly towards the centre of the package.

There will hereby be attained not only the advantage that a helical flow which reaches all pockets and nooks everywhere inside the package occurs, including the lower region, but also that the supplied gas, in a highly elegant and controlled manner, will depart from the package in a flow which is counter-directed to the helical flow and which takes place in or close to the centre of the package. This implies at the same time that a reuse of the supplied gases may simply be put into effect, for example in that an outlet may be provided in association with the centre of the gas supply apparatus according to the invention.

BRIEF DESCRIPTION OF THE ACCOMPANYING DRAWINGS

The present invention will now be described in greater detail hereinbelow, with reference to one embodiment shown on the accompanying Drawings. In the accompanying Drawings.

DETAILED DESCRIPTION OF THE INVENTION

Figure 1:
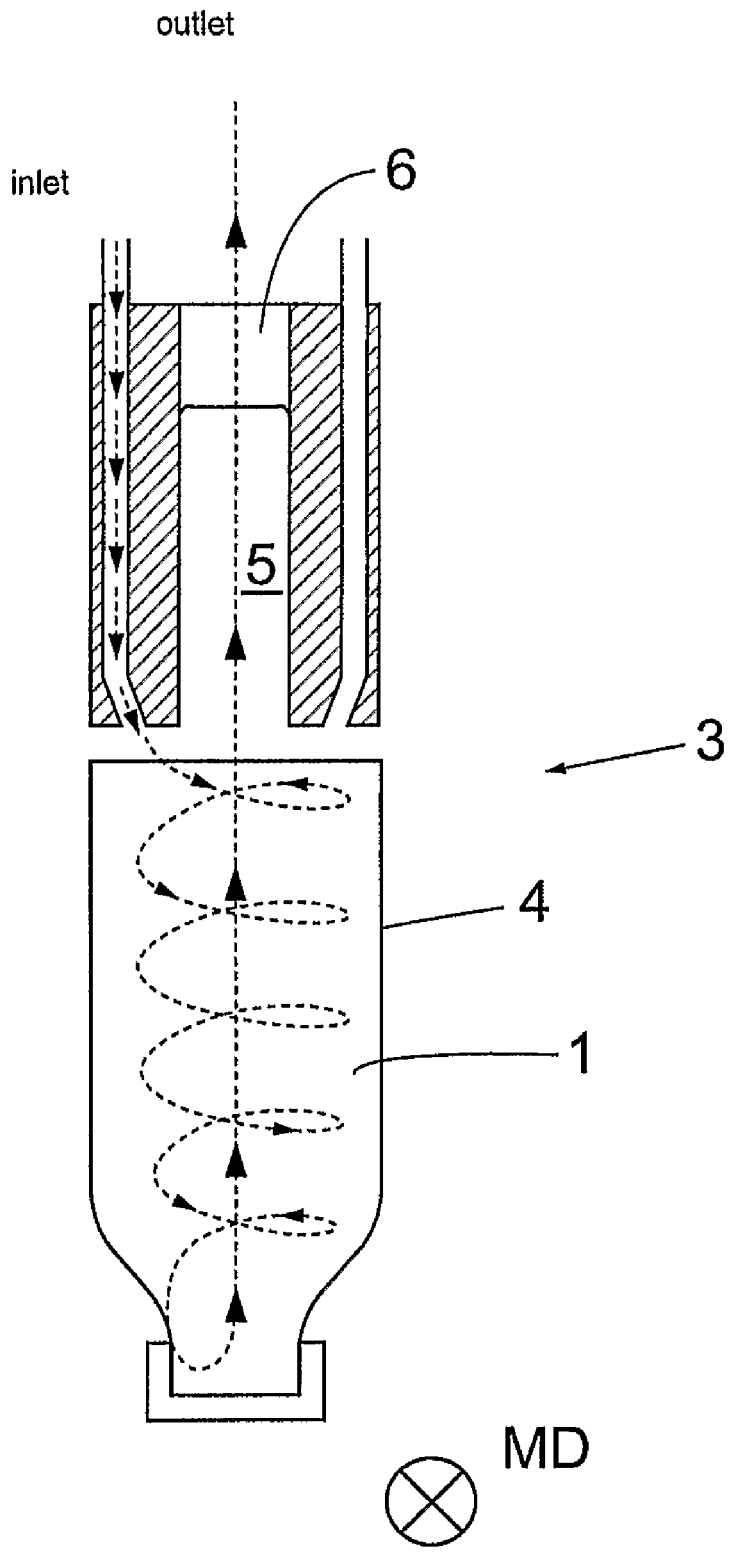
FIG. 1 is a cross sectional view of an apparatus according to the invention as an explicit illustration of the function of the invention.

The cross sectional view illustrated in FIG. 1 shows the fundamental function of the invention. A package 1 in a sequence of identical packages and with, in this case, an open bottom runs along a belt for the progressive indexing of, for example, four packages 1 at a time in the machine direction MD. Those stages through which the package at least thereby substantially passes are one for heating the package to about 70° C., one for sterilising the package with gaseous hydrogen peroxide or other sterilisation gas, and one for ventilation thereof with sterile air. In this context, it should be observed that these stages need not be wholly single action stages but, if desired, may be "phased" in the sense that, for example, the heating stage may progressively be mixed with the sterilisation stage in an increasing degree in the machine direction so that the number of sterilisation gas apertures increases progressively. With such a modification of the method of approach, a favourable effect in the form of a temporarily longer and thereby more efficient sterilisation will be achieved.

Once these stages have been passed through, filling takes place followed by sealing of each respective package 1. Regardless of whether it is hot air, sterilisation gas or sterile ventilation air which is supplied in the channels 2 illustrated in FIG. 1 in an apparatus 3 according to the invention, it may be ascertained that the flow which results in that the channels 2 are, in their lower ends, angled in such a manner that they make an angle of less than or equal to 8° to both of the planes of symmetry which display the symmetry axis H which intersects the opening of the package at a right angle as a common line, hence angled in a first direction somewhat peripherally and in a second direction slightly towards the centre of the package imparts the best conceivable vortex helical form to the gas flow angled down in the package on its way down. In order moreover when gas is supplied to achieve the best possible flow distribution all the way down in the "bottom" of the package 1, the number of channels should, as experiments have also demonstrated, be adapted to the volume of the packages or their circumference in association with the open end of the packages; the larger the volume/circumference the greater the number of channels. In the embodiment illustrated here, the apparatus includes ten channels 2 uniformly distributed along the upper region of the described apparatus 3. It is once again worthy of pointing out that the experiments which have been carried out with water as a medium have demonstrated that the medium which is fed via the channels 2 with this configuration will flow out of the package as a substantially central flow upwards in the package 1 in order, at its upper region 4, to be able to flow into a central return channel 5. As is intimated by broken lines in the upper part of the figure, the channel 5 may discharge straight up at reference numeral 6. The desired effect will thereby be attained depending upon the quantity of supplied gas, either as improved heating, improved sterilisation or improved ventilation.

Figure 2:
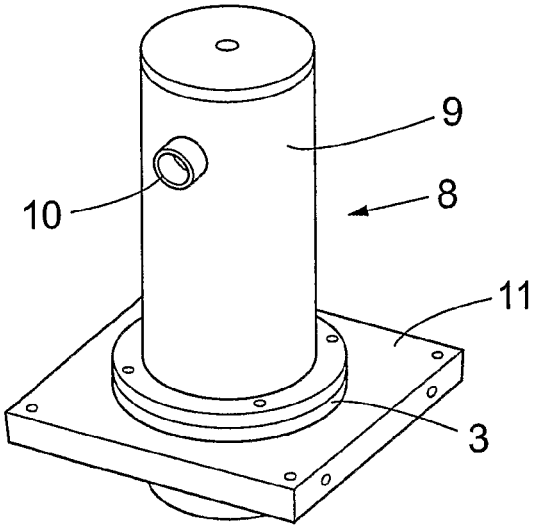
FIG. 2 is an isometric view of an actual apparatus according to the present invention.
Figure 3:
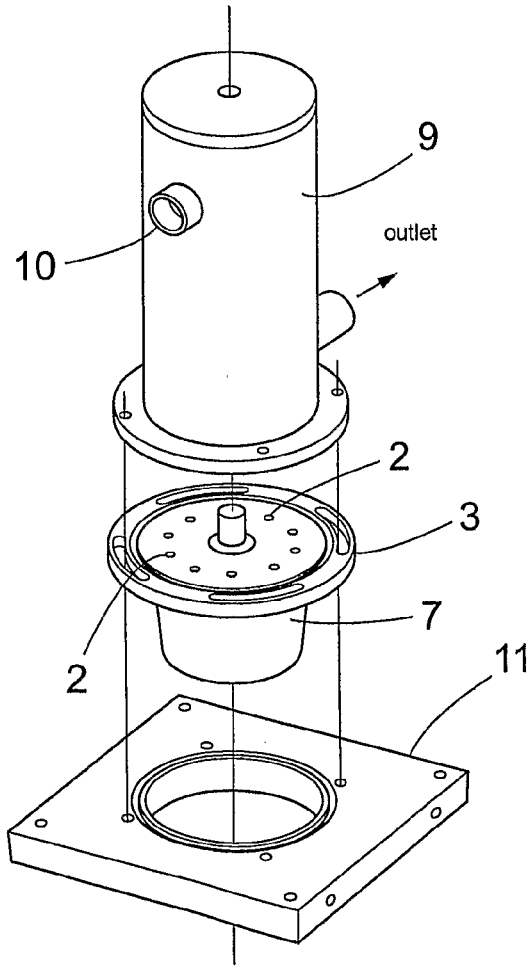
FIG. 3 is an isometric exploded view of the same apparatus.

FIG. 2 shows a gassing assembly 8 comprising an apparatus 3 according to the invention in an integrated composite state with the assembly 8. The assembly 8 has an inlet chamber 9 with a central gas inlet connection 10 and a plate 11 for fixing of the assembly to a filling machine (not shown). In association with FIG. 2, FIG. 3 is a perspective exploded view of the assembly 8. Thus, the apparatus 3 is also shown here in perspective, for which reason its various component parts, above all the channels 2 are clearly apparent. The fact that the channels 2 are ten in number is, as was mentioned above, a coincidence, since the number depends upon the circumference.

Figure 4:
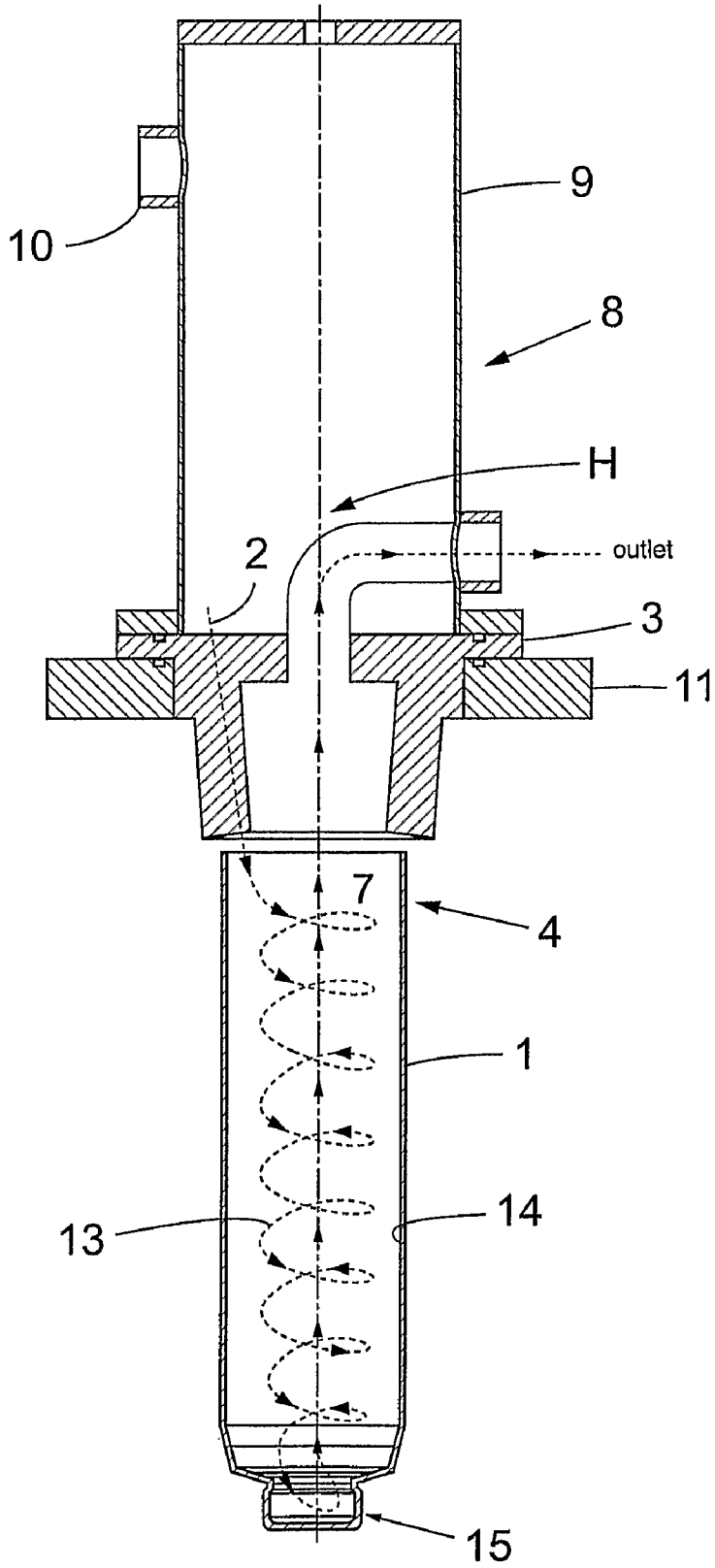
FIG. 4 is a cross section through the centre of the apparatus in question with a package intended for sterilisation located beneath.

Finally, FIG. 4 shows the assembly 8 as a central cross section in a position corresponding to that which the assembly 8 will have when it is run in production. With a view to making a comparison with FIG. 1 possible, this figure shows an imaginary flow pattern corresponding to that which is illustrated in the fundamental outline drawing in FIG. 1.

A brief description will be given below of the fundamental operation of the apparatus. Supply with gas of the desired type takes place continuously at the central inflow connection 10. In that the supplied gas first fills the inflow chamber 9, the flow which is fed to the package 1 via the channels 2 will be able to maintain a uniform and constant pressure. The channels 2 are obliquely inclined in the above described manner (less than 8° in relation to two mutually right angled planes of symmetry) thereby gives rise to a helical gas flow 13 along the inner periphery 14 of the package. When the gas flow reaches the bottom 15 of the package 1, the flow will, as a consequence of the lower gas pressure in the centre of the package, strive to leave the package in this section. Thus, the return flow also takes place out of the package of the supplied gas in a controlled manner. When the return flow reaches the bottom opening of the package 1, this is taken care of in the return channel 5, in whose upper region this is deflected approx. 180° in order to be led out via the outer periphery of the package. The present invention makes for a considerable reduction of the mass flow, whereby this flow no longer constitutes a potential risk for turbulent currents occurring in the interface region beside and beneath the package.

The invention claimed is:

1. In an apparatus in a filling machine, a method of supplying a gas or gas mixture to an interior of partly formed packages which are ready-to-fill, before a subsequent filling and sealing of the packages, wherein the gas or gas mixture supplied at any given moment is supplied as a flow which is radially outwardly and inwardly defined in relation to an inner wall of the package, the flow being angled with respect to a geometric major longitudinal axis of the package which intersects an opening of the package so that the flow, since it is defined by the inner wall of the package, is positively controlled for formation of a helical flow vortex.

2. The method as claimed in claim 1, wherein the interior of the packages is supplied, progressively via an open end of each package, with a sterile hot air flow, followed by a gaseous sterilisation agent flow, and then a sterile air flow.

3. The method as claimed in claim 1, wherein a gaseous sterilisation agent is progressively admixed to an initially supplied hot air gas flow in the machine direction (MD).

4. The method as claimed in claim 1, wherein the radial defining of the flow inwardly in the package is restricted by a return flow in the central region of each package.

5. The method as claimed in claim 1, wherein the flow is supplied by two or more channels per open package end.

6. The method as claimed in claim 4, wherein the channels are angled so that flow directions therefrom fall outside both planes of symmetry which have an axis of symmetry which at right angles intersects the opening of the package as a common line so that the channels are angled in a first direction somewhat peripherally and are angled in a second direction slightly towards the centre of the package.

7. The method as claimed in claim 6, wherein the channels are angled less than or equal to 8° in each of the first and second directions, respectively.

8. The method as claimed in claim 1, wherein the flow of the gas or gas mixture is maintained continuously over time.

9. The method as claimed in claim 1, wherein the gas or gas mixture is reused, wherein the gas or gas mixture in the package to be reused flows out of the package through an outlet provided centrally at a mouth of each respective package.

10. An apparatus in a filling machine for supplying gas or gas mixtures to an interior of packages before a subsequent filling and sealing thereof, comprising a nozzle which includes at least one channel for gas or gas mixture which is angled in relation to at least one plane containing one of the geometric major axes of the package which intersects an opening of the package at a right angle such that the flow from the channel, when it impinges on an inner wall of the package, develops a both radially inwardly and outwardly defined flow while forming a positively driven helical flow vortex.

11. The apparatus as claimed in claim 10, wherein the at least one channel comprises a plurality of channels angled so that a flow direction out of the channels falls outside planes which are parallel with any planes of symmetry which have an axis of symmetry intersecting the opening of the package at right angles as a common line, and are directed in a first direction somewhat peripherally and in a second direction slightly towards a center of the package.

12. The apparatus as claimed in claim 11, wherein the channels are angled less than or equal to 8° in each respective direction.

13. The apparatus as claimed in claim 10, further comprising gas recycling equipment comprising an outlet which is centrally placed in association with a mouth of each respective package.

14. In an apparatus in a filling machine, a method of supplying a gas or gas mixture to package before the package is filled with contents and sealed, the method comprising:

positioning a nozzle apparatus adjacent an open end of the package, which package possesses an interior, the nozzle apparatus comprising at least one channel;

supplying a flow of the gas or gas mixture into the interior of the package by way of the channel to produce a helical flow vortex in the interior of the package; and discharging the gas or gas mixture out of the interior of the package.

15. The method as claimed in claim 14, wherein the flow of the gas or gas mixture into the interior of the package is angled with respect to a geometric major longitudinal axis of the package which intersects the open end of the package.

16. The method as claimed in claim 14, wherein the supplying of the flow of the gas or gas mixture comprises supplying a flow of sterile hot air to the interior of the package by way of the channel, thereafter supplying a flow of gaseous sterilization agent to the interior of the package by way of the channel, and thereafter supplying a flow of sterile air to the interior of the package by way of the channel.

17. The method as claimed in claim 14, wherein the discharge of the gas or gas mixture is along a central region of the interior of the package.

18. The method as claimed in claim 14, the gas or gas mixture flows into the interior of the package by way of a plurality of channels.

19. The method as claimed in claim 18, wherein the channels are angled so that the flow out of the channels into the interior of the package is along directions outside both planes of symmetry which have an axis of symmetry which at right angles intersects the opening of the package as a common line so that the channels are angled in a first direction somewhat peripherally and are angled in a second direction slightly towards the centre of the package.

20. The method as claimed in claim 19, wherein the channels are angled less than or equal to 8° in each of the first and second directions.

* * * * *